US005966557A

United States Patent [19]

Wada

[11] Patent Number: 5,966,557

[45] Date of Patent: Oct. 12, 1999

[54] IMAGE STABILIZING CONTROL METHOD OFFERING A SHORT WAITING TIME FOR OPERATION RECOVERY AND IMAGE FORMING APPARATUS INCORPORATING SAID CONTROL METHOD

[75] Inventor: Kenichi Wada, Toyokawa, Japan

[73] Assignee: Minolta Co., Ltd., Osaka, Japan

[21] Appl. No.: 09/199,807

[22] Filed: Nov. 25, 1998

[30] Foreign Application Priority Data

Nov. 26, 1997 [JP] Japan ..... 9-342208

[51] Int. Cl.[6] ..... G03G 15/00

[52] U.S. Cl. ..... 399/43; 399/44

[58] Field of Search ..... 399/43, 44, 46, 399/49, 94, 97

[56] References Cited

U.S. PATENT DOCUMENTS

| | | | |
|---|---|---|---|
| 4,592,646 | 6/1986 | Suzuki et al. | 399/43 |
| 5,057,867 | 10/1991 | Ishigaki et al. | 399/43 |
| 5,387,965 | 2/1995 | Hasegawa et al. . | |
| 5,548,378 | 8/1996 | Ogata et al. | 399/13 |

FOREIGN PATENT DOCUMENTS 7-120992 5/1995 Japan .

*Primary Examiner*—Joan Pendegrass

*Attorney, Agent, or Firm*—Burns, Doane, Swecker & Mathis, LLP

[57] ABSTRACT

The differences in the detected values of temperature and humidity between the time at which the suspension of operation begins and the time at which operation is restored are sought, and the differences are compared with their respective prescribed thresholds. If the difference in temperature is less than the threshold and the difference in relative humidity is less than the threshold, as an example, it is determined that the environmental change during the period of suspension of operation is less than the threshold, and the copying machine is made ready immediately without performing image stabilizing control. On the other hand, where the difference in temperature equals or exceeds the threshold, or where the difference in relative humidity equals or exceeds the threshold, it is determined that the environmental change during the period of suspension of operation equals or exceeds the threshold, whereupon image stabilizing control is executed and the image forming operation parameters are set. The copying machine is then made ready.

24 Claims, 4 Drawing Sheets

IMAGE STABILIZING CONTROL METHOD OFFERING A SHORT WAITING TIME FOR OPERATION RECOVERY AND IMAGE FORMING APPARATUS INCORPORATING SAID CONTROL METHOD

This application is based on application No. 9-342208 filed in Japan, the contents of which is hereby incorporated by reference.

BACKGROUND OF THE INVENTION

1. Field of the Invention

The present invention pertains to an image forming apparatus that performs image stabilizing control, and more particularly, to image stabilizing control performed when the operation of the image forming apparatus is restored after it is suspended.

2. Description of the Related Art

Image stabilizing control to maintain high image quality for recorded images is performed in image forming apparatuses in general. For example, in image forming apparatuses using the electrophotographic method, a test toner image (patch) is formed on the photoreceptor and its density is detected and compared with an expected value. Based on the result of the comparison, the charger output to charge the surface of the photoreceptor and the developing bias voltage to be applied are adjusted. These operations are done in order to prevent the image quality from deteriorating due to the change in photoreceptor characteristics that is caused by an environmental change. The reference density value is the toner density that is expected from the charger output when forming the test toner image and the applied developing bias voltage (these may be called the image stabilizing parameters). Image stabilizing control to optimize these parameters is performed when the main switch is turned ON, before and after image formation, and when the apparatus returns to operation after operation is suspended due to some sort of failure, for example. Such control is particularly needed when recording color images or images as to which accurate gradation reproduction is required.

U.S. Pat. No. 5,387,965 discloses a control method in which the density of the test toner image formed on the photoreceptor is compared with the expected value and the target toner density value (target value during toner supply) in the developing device is corrected based on the result of the comparison. Through this control, the response to changes in the photoreceptor characteristics or changes in the developer characteristic that occur over time can be improved.

This image stabilizing control requires a certain period of time. For example, in an image forming apparatus using the electrophotographic method, a certain period of time is needed for the formation of a test toner image, the detection of the density of the test toner image, the setting of the voltage to charge the photoreceptor, and the setting of the developing bias voltage. Consequently, when the apparatus returns to operation after operation is suspended, the commencement of the image forming operation is delayed by the amount of time needed for performance of the image stabilizing control.

Suspension of operation of an image forming apparatus is caused due to some type of failure. The failure may be one that requires only a short suspension period before recovery, such as a recording paper jam, in which the problem is eliminated simply by removing the jammed paper. In such a case, the environmental factors (i.e., temperature and humidity) that affect the image stabilizing parameters do not change significantly during the time that operation is suspended. In many cases, good images can be formed even if the parameter values immediately before the suspension of operation are used in the image formation. If image stabilizing control is carried out in such cases, the commencement of the image forming operation is needlessly delayed.

On the other hand, where it takes a long time to remove the jammed paper or where the image forming apparatus is not used for a long time before or after the jammed paper is removed, the environmental values may change substantially during the time that operation is suspended. In such cases, image stabilizing control is essential even if the failure is simply a paper jam. In addition, some of the failures that cause suspension of the operation of the image forming apparatus consist of failures of the elements that directly affect image quality. Image stabilizing control is imperative in such a case as well.

SUMMARY OF THE INVENTION

The present invention was made in light of the situation described above. Its object is to achieve high image quality by performing image stabilizing control where it is needed and to reduce the waiting time before the image forming operation is begun by omitting image stabilizing control where it is not necessary when operation of the image forming apparatus has been restored after operation was suspended due to some sort of failure.

The first aspect of the present invention to attain this object provides an image forming apparatus that performs image forming operation by operating multiple image forming elements, comprising, an environmental value detector which detects an environmental value, a condition data detector which detects condition data regarding operating conditions of the image forming apparatus, image stabilizing control means for controlling an operation parameter of at least one of the image forming elements based on the condition data detected by the condition data detector, and control means for controlling a determination of whether to perform the control by said image stabilizing control means based on a difference between a first environmental value and a second environmental value, said first environmental value being detected by said environmental value detector when the operation of the image forming apparatus becomes suspended and said second environmental value being detected when it is restored.

The second aspect of the present invention provides an image forming apparatus having a charger which charges a photoreceptor and a developing device which forms a visible image on the photoreceptor, comprising, an environmental value detector which detects an environmental value, a potential detector which detects a surface potential of the photoreceptor charged by said charger, first image stabilizing control means for controlling an output of the charger depending on the detected surface potential by said potential detector such that the photoreceptor surface potential is made a desired level, a comparator which compares a difference in the environmental value detected by the environmental value detector between the time at which an operation of the image forming apparatus becomes suspended and the time at which it is restored with a prescribed threshold, and control means for permitting, where the difference in the environmental value exceeds the threshold, the control by the first image stabilizing control means when operation is restored, and prohibiting the control where the difference is under the threshold.

The third aspect of the present invention provides an image forming apparatus having a charger which charges a photoreceptor and a developing device which forms a visible image on the photoreceptor, comprising, an environmental value detector which detects an environmental value, a density sensor which detects a density of a test toner patch formed on the photoreceptor, image stabilizing control means for controlling at least one of an output of the charger and a developing bias voltage the developing device depending on the detected density by said density sensor, a comparator which compares a difference in the environmental value detected by the environmental value detector between the time at which an operation of the image forming apparatus becomes suspended and the time at which it is restored with a prescribed threshold, and control means for permitting, where the difference in the environmental value exceeds the threshold, the control by the first image stabilizing control means when operation is restored, and prohibiting the control where the difference is under the threshold.

The fourth aspect of the present invention comprises an image stabilizing control method for an image forming apparatus having environmental value detection sensors that detect the environmental values, said apparatus operating multiple image forming elements to perform an image forming operation, wherein said method comprises a step in which the first environmental values are detected by the environmental value detection sensors when the operation of the apparatus becomes suspended, a step in which the second environmental values are detected by the environmental value detection sensors when the operation of the apparatus is restored, a step in which it is determined whether the differences between the first and second environmental values are larger than the prescribed thresholds, and a step in which, where the differences equal or exceed the thresholds, the image stabilizing control to set the settings of the various image forming elements to the optimal values is executed, but where the differences do not exceed the threshold, the execution of the image stabilizing control is prohibited.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

The present invention is explained below with regard to a digital color copying machine using the electrophotographic method. The present invention, however, is not limited to application in electrophotographic copying machines, but may be applied in copying machines using other image forming methods such as the inkjet method. It may be applied in either digital or analog machines, or in full-color, monochrome or limited-color copying machines. Further, it is not limited to application in copying machines, but may be applied in other image forming apparatuses such as printers or facsimile machines.

Figure 1:
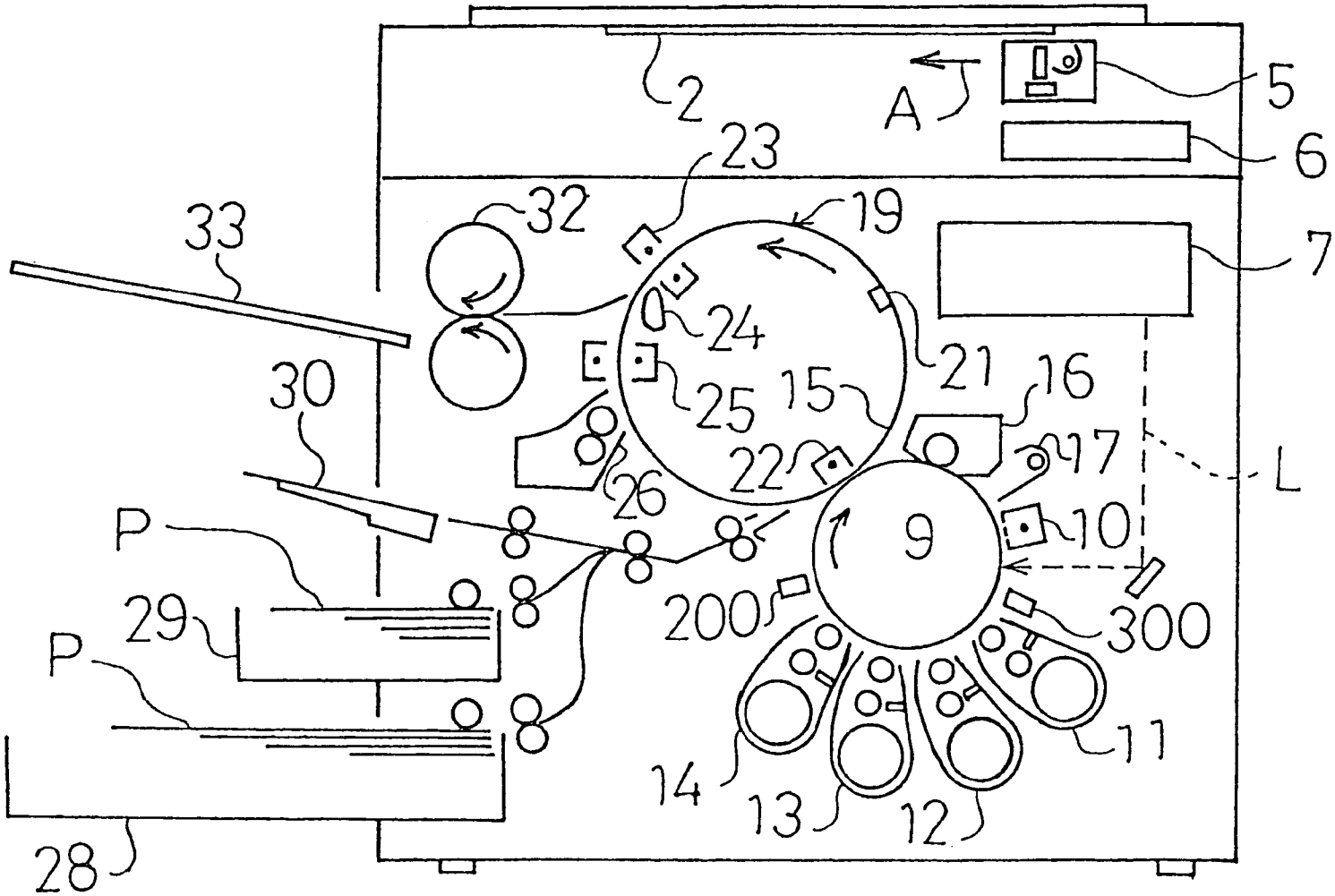
FIG. 1 is a simplified drawing showing the construction of the copying machine of an embodiment pertaining to the present invention.

FIG. 1 is a simplified drawing to explain the construction of the copying machine. In the copying machine shown in this drawing, an original document sheet placed on the platen glass 2, with the side to be copied facing down, is read by the scanning optical device 5 that moves in the direction of the arrow A. The image signals obtained are input to the image signal processor 6, and after the signals undergo public-domain processing by the image signal processor 6, image data is generated and saved in memory. The image data is then read in the order of yellow, magenta, cyan and black, and is sequentially sent to the laser exposure device 7. Laser beam L that is modulated based on the image data is output from the laser device 7 to expose the charged surface of the photoreceptor drum 9.

Figure 4:
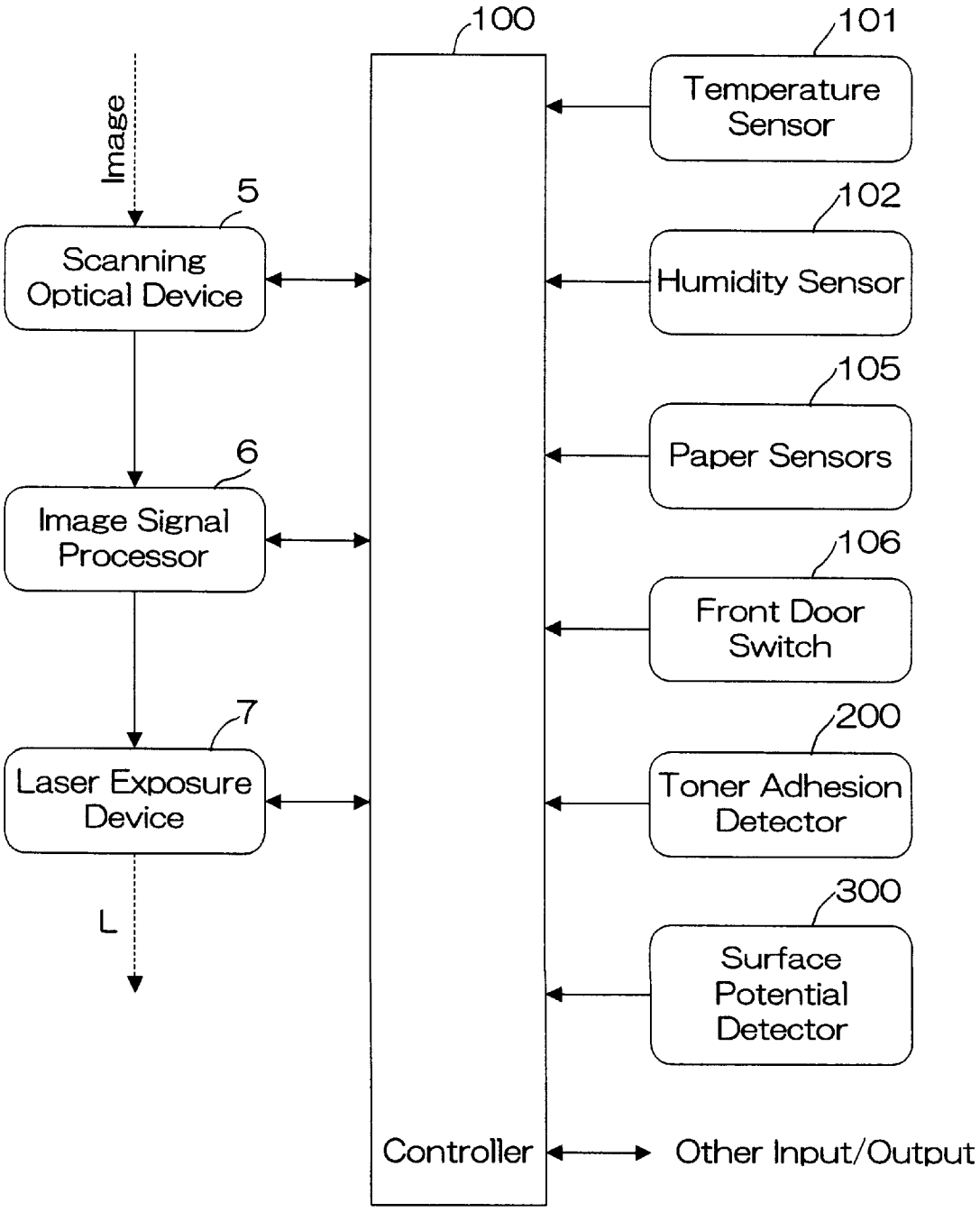
FIG. 4 is a block diagram showing the control circuit of the copying machine shown in FIG. 1.

Around the photoreceptor drum 9 are located a charger 10, a surface potential detector 300, a yellow developing device 11, a magenta developing device 12, a cyan developing device 13, a black developing device 14, a toner adhesion detector (density sensor) 200, a cleaner 16 and a discharge device 17. The surface potential detector 300 and the toner adhesion detector 200 may have a means to calculate the detection result internally, but in this embodiment, only sensor elements are located around the photoreceptor drum 9, such that the detection signals of the sensor elements are sent to the controller 100 (FIG. 4) and the processing described below takes place by means of the controller 100.

When the surface of the photoreceptor drum 9, which is uniformly charged by the charger 10, is exposed by the laser beam L as described above, an electrostatic latent image that corresponds to the image data is formed. In other words, electrostatic latent images corresponding to yellow, magenta, cyan and black are sequentially formed. Each of the electrostatic latent images is sequentially developed into a toner image by the developing device housing the corresponding toner.

The toner images thus developed are sequentially transferred to the sheet of recording paper wrapped around the transfer device 19 and are overlaid onto each other without misalignment. For this purpose, a transfer charger 22 is located in the interior space of the transfer device 19 at a position at which it faces the photoreceptor drum 9. A chucking device 21 to grasp the leading edge of the sheet of recording paper is located on the outer surface of the transfer device 19. Further, a first discharge device 23, a sheet separating device 24, a second discharge device 25 and a cleaner 26 are located on the inner and outer surfaces of the transfer device 19 on the downstream side of the transfer charger 22.

A sheet of recording paper P is supplied from paper cassette 28 or 29 or manual insertion tray 30, and is wrapped around the outer surface of the drum 15 of the transfer device 19 by means of the chucking device 21. When transfer of the toner images of all four colors is completed, the sheet of recording paper is separated from the drum 15 of the transfer device 19. After undergoing fusing by means of the fusing device 32 via heat and pressure, the sheet is ejected onto the paper eject tray 33 outside the machine. A color digital image is formed on the sheet of recording paper P in this way.

The efficiency of the charging of the photoreceptor drum 9 is obtained before the image forming operation described above and a charge output (grid voltage) during the image forming operation is set in this copying machine. In other words, prior to the image forming operation, the charger 10 is operated to charge the photoreceptor drum 9 in an operation not intended directly for image forming, and one to ten different potentials are created on the surface of the photoreceptor drum 9. These potentials thus created are detected by the surface potential detector 300, and the charging efficiency is calculated based on the detection results as well as on the outputs from the charger 10 that correspond to the detection results. The output from the charger 10 during the image forming operation is controlled based on this charging efficiency such that the surface of the photoreceptor drum 9 is charged to a desired potential level. This control is deemed the first image stabilizing control. This may be performed after the completion of the image forming operation.

Furthermore, in this copying machine, a test toner image is formed on the surface of the photoreceptor drum 9 after the image formation operation described above is performed and the amount of adhering toner is detected. The control data optimized based on the detection result is used in the control during the next image forming operation. In other words, separate from image forming operation, the charger 10 is operated to charge the photoreceptor drum 9, and a developing bias voltage is applied to the developing sleeve of the developing device, so that a test toner image is formed on the surface of the photoreceptor drum 9. The physical amount that indicates the density of this toner image (here, the amount of reflected light) is detected by the toner adhesion detector (density sensor) 200. Based on this detection result and its relationships to the output from the charger 10 and the applied developing bias voltage that corresponds to this detection result, the output from the charger 10 and the developing bias voltage that are needed to obtain an image having a desired density are sought and are used as control data in the next image forming operation. This control is deemed the second image stabilizing control operation. This may be performed prior to the image forming operation.

The control sequence when a paper jam has occurred in the copying machine is explained below with reference to the flow chart of FIG. 2. The occurrence of a paper jam may be detected through a public-domain calculation by the controller 100 based on detected/not detected signals from the multiple recording paper detection sensors 105 located in the paper conveyance path inside the copying machine and time at which the recording paper is expected to pass as it is conveyed.

When a jam occurs (S12) during the image forming operation (S11), the operation of the copying machine is suspended and the copying machine enters a down state. The temperature and humidity (environmental values) inside the copying machine at the beginning of the suspension of operation are detected by the temperature sensor 101 and the humidity sensor 102 located at appropriate points inside the copying machine and are saved in memory (S13). When the jammed sheet of recording paper is removed by the operator (S14) and the front cover of the copying machine is closed, the front door switch 106 that detects the restoration of operation turns ON (S15), and the temperature and humidity inside the copying machine at the time of recovery are detected by the temperature sensor 101 and the humidity sensor 102 (S16).

The differences in the detected values of temperature and humidity between the time at which the suspension of operation begins and the time at which operation is restored are sought, and the differences are compared with their respective prescribed thresholds. If the difference in temperature is less than 5° C. and the difference in relative humidity is less than 10%, as an example, it is determined that the environmental change during the period of suspension of operation is less than the threshold (NO in S17), and the copying machine is made ready immediately without performing image stabilizing control (Sl9). In other words, execution of an image forming operation is permitted. In this case, for the image forming operation parameters (the control data for the output from the charger 10 and the control data for the developing bias voltage to be applied), the same data that was used prior to the suspension of operation is used. On the other hand, where the difference in temperature equals or exceeds 5° C., or where the difference in relative humidity equals or exceeds 10%, it is determined that the environmental change during the period of suspension of operation equals or exceeds the threshold (YES in S17), whereupon image stabilizing control (the first image stabilizing control and/or the second image stabilizing control) is executed and the image forming operation parameters are set (S18). The copying machine is then made ready (S19).

The thresholds to which the temperature difference or the humidity difference are compared may be changed depending on the components of the copying machine, the models of the components, the installation environment and the history of the copying machine. Where an indicator to indicate the environment other than the temperature difference or the humidity difference is available, that indicator may be processed in the same way. In addition, instead of the expressions 'equals or exceeds' and 'less than', 'exceeds' and 'equals or is less than' may be used together with thresholds that are appropriate when these expressions are used. Moreover, in the copying machine described above, it is determined that the threshold is not reached when both the temperature difference and the humidity difference are less than their respective thresholds, and that a threshold is reached or exceeded when either the temperature difference or the humidity difference equals or exceeds the threshold, but this is only an example. It is acceptable if it is determined that the threshold is not reached when either the temperature difference or the humidity difference falls short of the threshold and that the threshold is reached or exceeded when both the temperature difference and the humidity difference equal or exceed their respective thresholds.

Figure 2:
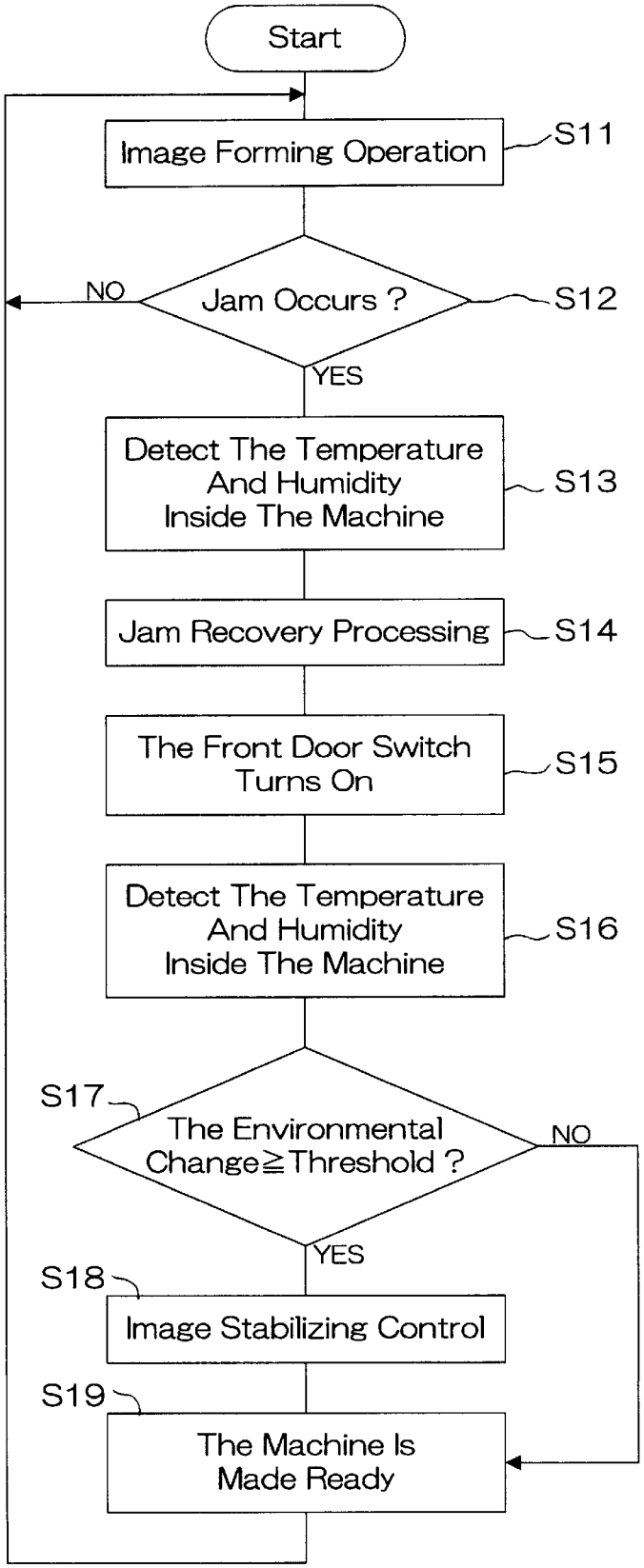
FIG. 2 is a flow chart showing one example of the image forming procedure.
Figure 3:
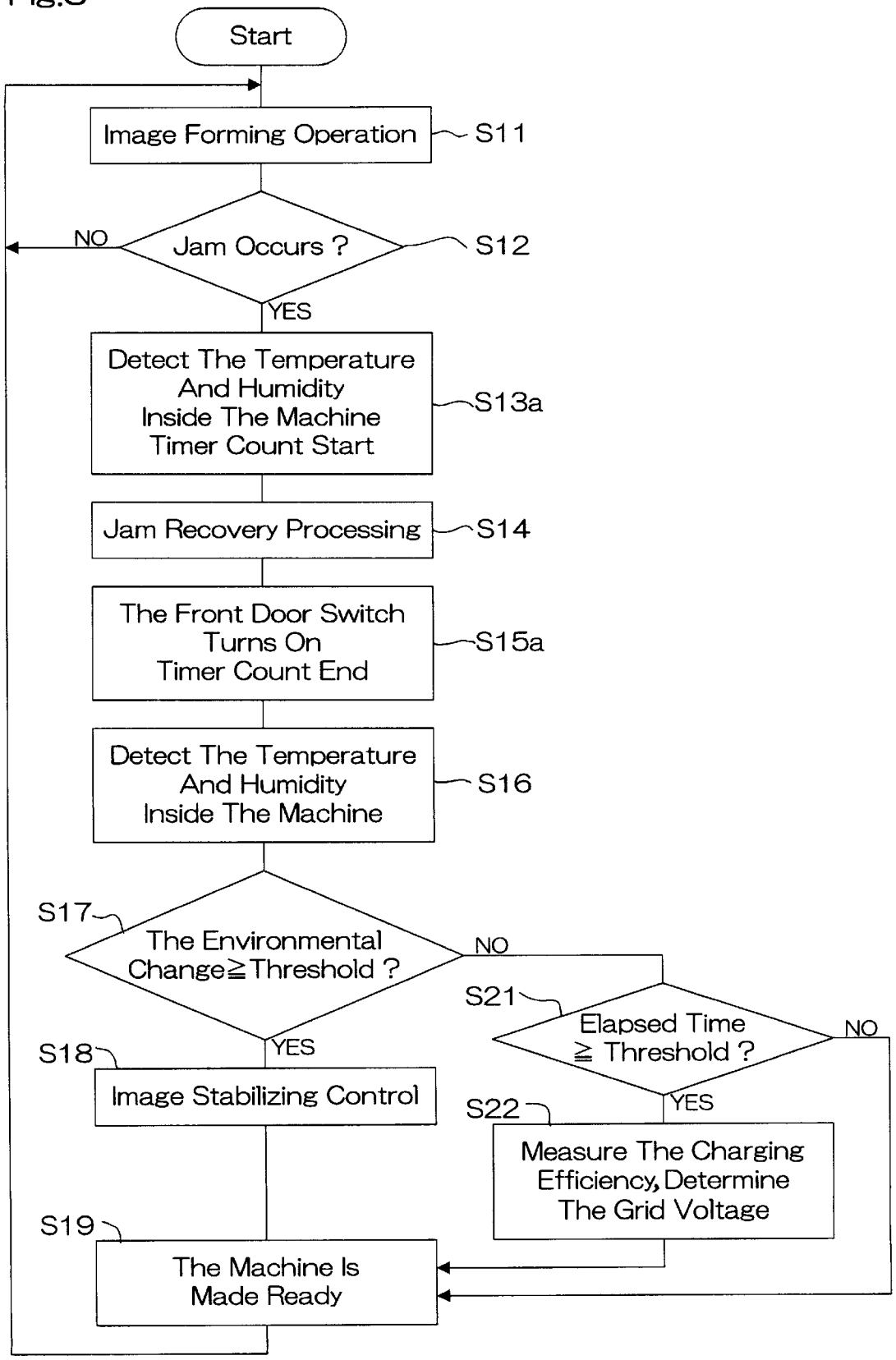
FIG. 3 is a flow chart showing another example of the image forming procedure.

In FIG. 2, the determination of whether to perform image stabilizing control is made considering only the differences in environmental factors (temperature and humidity) between the time at which the operation becomes suspended and the time at which it is restored. An example is shown in FIG. 3, in which the determination is made based on the differences in the environmental factors as well as on the time that elapses after the suspension of operation. The example of FIG. 3 takes into account the fact that, when the period after the suspension of operation exceeds a certain time period (three minutes in this example), there is an increased possibility that the photoreceptor drum 9 charging efficiency will change. Therefore, even where the differences in the environmental factors are below the thresholds (NO in S17), if the period in which operation is suspended equals or exceeds the threshold (YES in S21), the charging efficiency is measured through the first image stabilizing control operation to determine control data for the grid voltage to apply to the charger 10 (S22), and the data thus determined is used in the image forming operation. For parameters other than the grid voltage, the control data existing immediately before the suspension of operation is used.

In the example shown in FIG. 3, for the purpose of the determination in step S21, a timer counter is started when the suspension of operation begins, and the count value is detected when operation is restored (S13*a*, S15*a*). The point in time at which the timer counter is started is in principle the time at which the suspension of operation begins, but where the copying machine is disabled again immediately after the turning ON of the front door switch because the jammed paper was not removed by mistake, the time at which the timer counter is started may be the first point in time at which the copying machine operation is suspended.

In the explanation given with regard to FIG. 3 above, the same numbers as those used for the steps in common with FIG. 2 are used, and their explanation is omitted.

In the examples shown in FIGS. 2 and 3, a situation in which the operation of the copying machine becomes suspended due to a recording paper jam is shown. Where the operation of the copying machine is suspended due to other failures (e.g., paper empty, toner empty, or abnormalities in the fusing device, the photoreceptor drum 9, the developing devices, or the sensors), the control operation shown in FIG. 2 or FIG. 3 may not be the most appropriate control operation.

For example, some types of failures inevitably affect one or more of the parameters described above involved in image formation. Where any of these types of failures occurs, a construction is preferred in which image stabilizing control is executed at all times when operation is restored regardless of the differences in the environmental factors between the time at which the operation becomes suspended and the time at which it is restored. This construction can be achieved by adding in FIG. 2 a routine in which the cause of the suspension of operation is determined and image stabilizing control is performed at all times regardless of the differences in the environmental factors, depending on the type of failure. Specifically, a step in which it is determined whether the cause of the suspension of operation is any of the prescribed causes should be inserted before step S17, such that if the determination result is YES, the controller moves to the process of step S18 without performing the determination in step S17.

In addition, a user that places priority on image quality desires a construction in which image stabilizing control is not omitted, even if that lengthens the process, while a user that places priority on productivity desires a construction in which image stabilizing control is omitted to the extent possible, even if that results in lesser image quality. Taking this into consideration, a construction in which the user can choose whether to execute image stabilizing control is preferred. This construction can be achieved by adding an input means to set the mandatory control mode as well as adding in FIG. 2 a routine in which the mandatory control mode (the mode in which image stabilizing control is carried out at all times regardless of the environmental factors) is set if an input from the input means is detected. Specifically, a step in which it is determined whether or not the mandatory control mode is present should be inserted before step S17, such that if the determination result is YES, the controller moves to the process of step S18 without performing the determination in step S17. The function of the input means may also be reversed, i.e., the construction may be such that the mandatory control mode is canceled if an input from the input means is detected.

In the examples described above, a failure is used as the cause of the suspension of operation of the copying machine, but the present invention is not limited to suspension of operation caused by a failure. It may be applied to suspension of operation caused by automatic power OFF during energy save mode or turning OFF of the main switch.

As described above, using the construction of the embodiment pertaining to the present invention, where the differences in the environmental values (the temperature and the humidity) equal or exceed the prescribed thresholds, image stabilizing control is determined to be necessary and is thus permitted, which enables high quality image formation. In addition, where the differences in the environmental values are less than the thresholds, image stabilizing control is determined to be unnecessary and is therefore prohibited, and consequently, image formation is immediately begun, eliminating any wasteful waiting period.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus that performs image forming operation by operating multiple image forming elements, comprising:

an environmental value detector which detects an environmental value;

a condition data detector which detects condition data regarding operating conditions of the image forming apparatus;

image stabilizing control means for controlling an operation parameter of at least one of the image forming elements based on the condition data detected by the condition data detector; and control means for controlling a determination of whether to perform the control by said image stabilizing control means based on a difference between a first environmental value and a second environmental value, said first environmental value being detected by said environmental value detector when the operation of the image forming apparatus becomes suspended and said second environmental value being detected when it is restored.

2. An image forming apparatus as claimed in claim 1, wherein said control means, where the difference in the environmental value exceeds a threshold, permits the control by said image stabilizing control means, and that prohibits the control where the difference is under the threshold.

3. An image forming apparatus as claimed in claim 2, wherein said control means, where the difference in the environmental value is under the threshold, sets the operation parameter existing prior to the suspension of the operation.

4. An image forming apparatus as claimed in claim 1, further comprising:

timer means for checking a time that has elapsed since the suspension of the operation;

wherein said control means, where the time checked by the timer means exceeds a prescribed period, permits the control by said image stabilizing control means when the operation is restored regardless of the difference in the environmental value.

5. An image forming apparatus as claimed in claim 1, wherein said control means, where the suspension occurs due to a prescribed malfunction, executes the control by the image stabilizing control means when the operation is restored regardless of the difference in the environmental value.

6. An image forming apparatus as claimed in claim 1, further comprising:

input means for setting a mandatory control mode in which the image stabilizing control means is performed regardless of the situation;

wherein said control means, where the mandatory control mode is present, executes the control by the image stabilizing control means when the operation is restored regardless of the difference in the environmental value.

7. An image forming apparatus as claimed in claim 1, wherein said environmental value detector includes a temperature sensor for detecting a temperature as an environmental value.

8. An image forming apparatus as claimed in claim 1, wherein said environmental value detector includes a humidity sensor for detecting a humidity as an environmental value.

9. An image forming apparatus as claimed in claim 1, wherein said condition data detector includes a surface potential detector for detecting a surface potential on a photoreceptor.

10. An image forming apparatus as claimed in claim 1, wherein said condition data detector includes a density sensor for detecting a density of a test toner patch formed on a photoreceptor.

11. An image forming apparatus as claimed in claim 1, wherein said image forming elements includes a charger for charging a photoreceptor, and said image stabilizing control means controls the operation parameter regarding an output of the charger.

12. An image forming apparatus as claimed in claim 1, wherein said image forming elements includes a developing device for developing a latent image formed on a photoreceptor, and said image stabilizing control means controls the operation parameter regarding a developing bias voltage of the developing.

13. An image forming apparatus having a charger which charges a photoreceptor and a developing device which forms a visible image on the photoreceptor, comprising:

an environmental value detector which detects an environmental value;

a potential detector which detects a surface potential of the photoreceptor charged by said charger;

first image stabilizing control means for controlling an output of the charger depending on the detected surface potential by said potential detector such that the photoreceptor surface potential is made a desired level;

a comparator which compares a difference between a first environmental value and a second environmental value, said first environmental value being detected by said environmental value detector when the operation of the image forming apparatus becomes suspended and said second environmental value being detected when it is restored, with a prescribed threshold; and control means for permitting, where the difference in the environmental value exceeds the threshold, the control by the first image stabilizing control means when operation is restored, and prohibiting the control where the difference is under the threshold.

14. An image forming apparatus as claimed in claim 13, further comprising:

a density sensor which detects a density of a test toner patch formed on the photoreceptor; and second image stabilizing control means for controlling at least one of an output of the charger and a developing bias voltage the developing device depending on the detected density by said density sensor;

wherein said control means controls a execution of the control by said second image stabilizing control means based on the comparison result by said comparator.

15. An image forming apparatus as claimed in claim 13, wherein said control means, where the differences in the environmental value is under the threshold, sets a charger output and a developing bias voltage existing prior to the suspension of the operation.

16. An image forming apparatus as claimed in claim 13, further comprising:

timer means for checking a time that has elapsed since the suspension of the operation;

wherein said control means, where the time checked by the timer means exceeds a prescribed period, permits the control by said first image stabilizing control means when the operation is restored regardless of the difference in the environmental value.

17. An image forming apparatus as claimed in claim 13 wherein said control means, where the suspension occurs due to a prescribed malfunction, executes the control by the first image stabilizing control means when the operation is restored regardless of the difference in the environmental value.

18. An image forming apparatus as claimed in claim 13, further comprising:

input means for setting a mandatory control mode in which the first image stabilizing control means is performed regardless of the situation;

wherein said control means, where the mandatory control mode is present, executes the control by the first image stabilizing control means when the operation is restored regardless of the difference in the environmental value.

19. An image forming apparatus having a charger which charges a photoreceptor and a developing device which forms a visible image on the photoreceptor, comprising:

an environmental value detector which detects an environmental value;

a density sensor which detects a density of a test toner patch formed on the photoreceptor;

image stabilizing control means for controlling at least one of an output of the charger and a developing bias voltage the developing device depending on the detected density by said density sensor;

a comparator which compares a difference between a first environmental value and a second environmental value, said first environmental value being detected by said environmental value detector when the operation of the image forming apparatus becomes suspended and said second environmental value being detected when it is restored, with a prescribed threshold; and control means for permitting, where the difference in the environmental value exceeds the threshold, the control by the first image stabilizing control means when operation is restored, and prohibiting the control where the difference is under the threshold.

20. An image forming apparatus as claimed in claim 19, wherein said control means, where the differences in the environmental value is under the threshold, sets a charger output and a developing bias voltage existing prior to the suspension of the operation.

21. An image forming apparatus as claimed in claim 19, further comprising:

timer means for checking a time that has elapsed since the suspension of the operation;

wherein said control means, where the time checked by the timer means exceeds a prescribed period, permits the control by said image stabilizing control means when the operation is restored regardless of the difference in the environmental value.

22. An image forming apparatus as claimed in claim 19 wherein said control means, where the suspension occurs due to a prescribed malfunction, executes the control by the image stabilizing control means when the operation is restored regardless of the difference in the environmental value.

23. An image forming apparatus as claimed in claim 19, further comprising:

input means for setting a mandatory control mode in which the first image stabilizing control means is performed regardless of the situation;

wherein said control means, where the mandatory control mode is present, executes the control by the image stabilizing control means when the operation is restored regardless of the difference in the environmental value.

24. An image stabilizing control method for an image forming apparatus having an environmental value detection sensor that detects an environmental value, said apparatus operating multiple image forming elements to perform an image forming operation, comprising the steps of:

detecting a first environmental values by the environmental value detection sensor when the operation of the apparatus becomes suspended;

detecting a second environmental values by the environmental value detection sensor when the operation of the apparatus is restored;

determining whether a difference between the first and second environmental values are larger than a prescribed threshold; and executing an image stabilizing control to set operation parameters of the various image forming elements to the optimal values where the difference exceeds the threshold, and prohibiting the execution of the image stabilizing control where the difference do not exceed the threshold.

* * * * *